United States Patent [19]

Tuson

[11] 3,980,037

[45] Sept. 14, 1976

[54] APPARATUS FOR MOORING SHIPS

[75] Inventor: Samuel Tuson, Mesnil-le-Roi, France

[73] Assignee: Entreprise d'Equipements Mecaniques Hydrauliques E.M.H., Boulogne, France

[22] Filed: Jan. 17, 1975

[21] Appl. No.: 541,949

[30] Foreign Application Priority Data

Feb. 12, 1974 France ..... 74.04643

[52] U.S. Cl. ..... 114/230; 9/8 P; 141/388

[51] Int. Cl.[2] ..... B63B 21/00

[58] Field of Search ..... 114/230, 206 R; 9/8 P; 61/46, 46.5; 141/387, 388; 254/178; 137/236

[56] References Cited

UNITED STATES PATENTS

| | | | |
|---|---|---|---|
| 224,083 | 2/1880 | Furman | 114/230 X |
| 2,986,889 | 6/1961 | Ludwig | 61/46.5 |
| 3,712,068 | 1/1973 | Leautaud | 9/8 P |
| 3,778,854 | 12/1973 | Chow | 9/8 P |
| 3,863,590 | 2/1975 | Karl et al. | 114/230 |

*Primary Examiner*—Duane A. Reger
*Assistant Examiner*—Sherman D. Basinger
*Attorney, Agent, or Firm*—Larson, Taylor and Hinds

[57] ABSTRACT

Mooring apparatus for ships, particularly tankers comprises a cable which is retractable into a column which is pivotally connected to a base anchored to the sea bed. The cable is retracted by a counterweight or similar device, is withdrawn from the column by traction exerted by the ship being moored, and is arrested by engagement of the counterweight against an upper stop associated with the column.

8 Claims, 5 Drawing Figures

Fig.1.
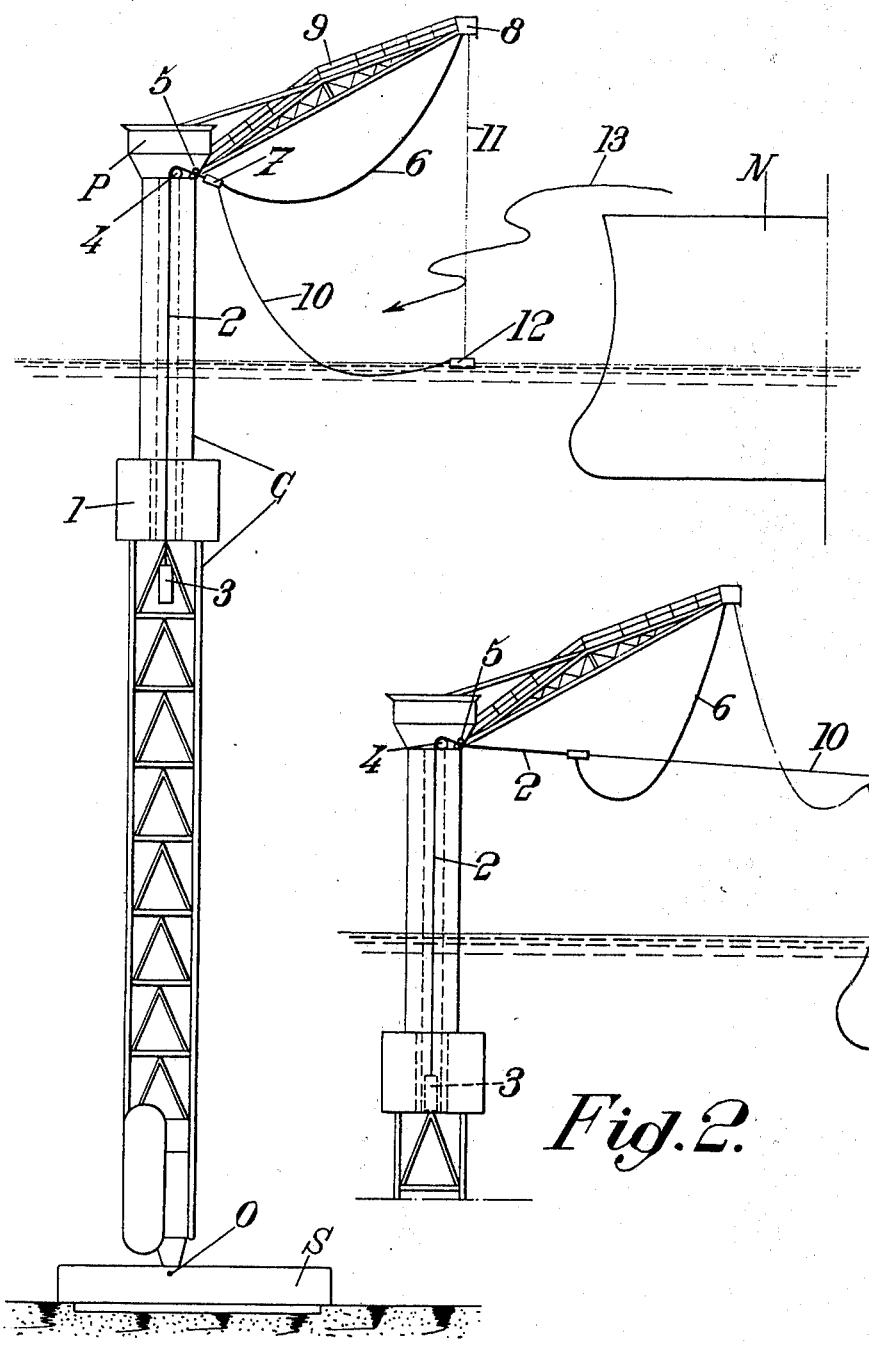
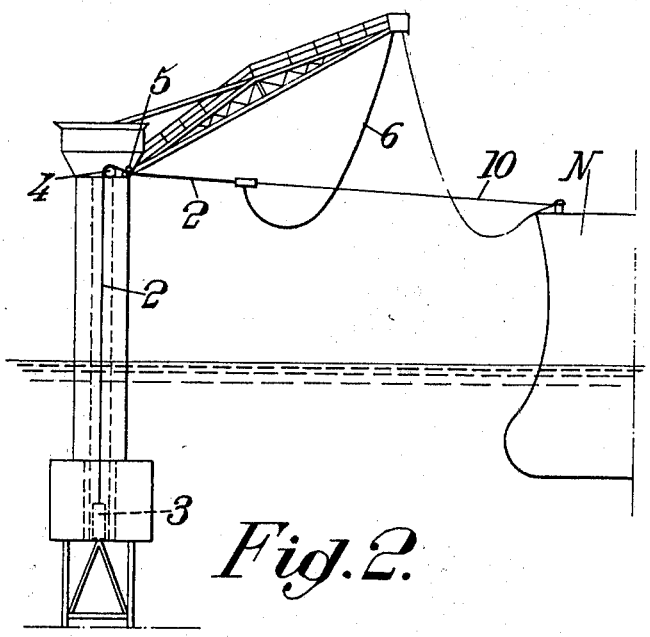
Fig.2.

APPARATUS FOR MOORING SHIPS

BACKGROUND OF THE INVENTION

1. Field of the Invention

This invention relates to apparatus for mooring ships, particularly for mooring tankers.

2. Description of the Prior Art

It is known to effect mooring to platforms provided with winches on which are wound cables or hawsers, which for mooring purposes are unwound from the drums of the winches. This method has various disadvantages, particularly the large size of the winches and the operating difficulties to which they give rise. In such instances it is usual that a flexible hose for connecting delivery pipes are wound on a winch, which contributes towards deterioration of the hose.

It is an object of the invention to provide mooring apparatus which overcomes these disadvantages.

SUMMARY

According to the invention there is provided apparatus for mooring ships, particularly for tankers, comprising a column adapted to be pivotally connected to a base anchored to the sea bed, and a mooring cable which is retractable into the column under the action of a counterweight or similar device, the cable being arranged to be extracted for the purpose of mooring a ship by traction applied from the ship to raise the counterweight against an upper stop associated with the column.

In a preferred embodiment the apparatus includes a platform mounted on the column to be orientable about the axis thereof and which carries at the end of a jib a flexible connecting hose intended to make connection between pipes of a ship and pipes carried by the platform and the column, wherein the free end of the flexible hose is connected to the end of the mooring cable so that for mooring purposes the cable and the hose are operated simultaneously. This arrangement enables the flexible hose to be easily connected to the corresponding end of pipes on the ship and it is not necessary to wind the hose on a winch.

The platform is mounted for rotation about the axis of the column supporting it, and the arrangement is such that as the platform assumes a determined orientation under the action of the traction applied by the ship to the mooring cable the jib takes up position which in plan, assumes a predetermined angle in relation to the said orientation, thus facilitating the operations by preventing the various cables or hoses from obstructing one another.

In order to enable the crew of a ship to pick up without difficulty the end of the mooring cable for the purpose of extracting it from the column, it is advantageous to use a rope connecting the said end to the top of the jib, the rope being associated with a float which contributes towards the stabilization of the rope. Members of the crew then make connection with the rope for the purpose of gripping both it and, at the same time, the aforesaid cable.

BRIEF DESCRIPTION OF THE DRAWINGS

FIG. 1 is a diagrammatic elevation of apparatus according to the invention,

FIG. 2 illustrates the apparatus in an intermediate phase of a mooring operation.

DESCRIPTION OF THE PREFERRED EMBODIMENT

Figure 3:
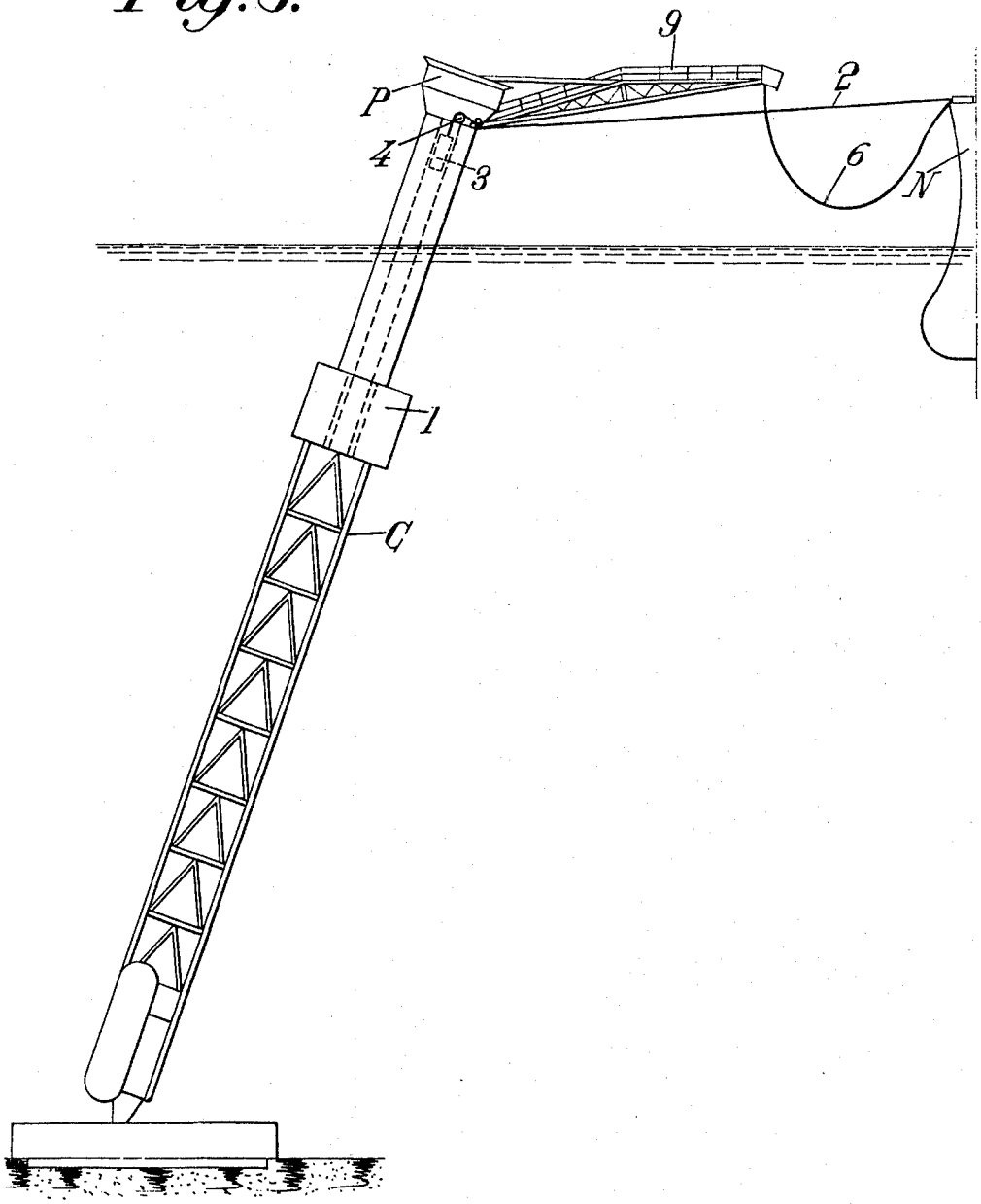
FIG. 3 illustrates the apparatus at the end of a mooring operation.

Referring to the drawings, a platform P for the extraction or storage of petroleum products is mounted in such a manner as to be orientable on a column C fastened pivotally at 0 (for example by a universal joint) to a base S anchored to the sea bed, and when it is proposed to moor a ship N to this arrangement, the procedure is generally as follows:

The column C remains substantially vertical, being provided for this purpose with at least one float 1 suitably disposed, particularly in its upper portion, which float applies a hydrostatic reaction from bottom to top, thus largely compensating for the weight of the column. When no ship is moored to it, the column is thus subjected only to slight oscillation due to the swell of the sea.

For the purpose of mooring a ship, a mooring cable or hawser 2 is provided which, instead of being wound on winches in the usual manner, normally remains suspended inside the column C under the action of a counterweight 3; as can be seen in the drawings, the cable 2 passes at its top part over at least one pulley 4, and passes out laterally, for example between at least two rollers 5.

The mooring operation will therefore consist in picking up the end of the cable passing out between rollers 5 and of applying traction to the cable in order to attach it to the ship. In this operation only the action of the counterweight 3 will have to be overcome.

At this point it should be stated that the mooring operation generally has the purpose of making a connection between pipes on the ship and pipes provided inside the column C, this connection being made by means of a flexible hose, such as that shown at 6 in the drawing. The hose 6, will for example, be supported by the top end of a jib 9 the base of which is articulated to the platform P.

As the operation of connecting the pipe 6 to the corresponding pipes on the ship must be effected simultaneously with the mooring, according to one particular arrangement of the invention it is advantageous for the free end of the flexible hose 6 to be fastened to the corresponding end 7 of the mooring cable 2, so that as the cable 2 is extracted the corresponding end of the hose 6 is brought nearer to the ship.

Furthermore, with regard to the means to be provided for effecting the extraction of the cable 2 and bringing the hose 6 closer to the ship, it is advantageous to make use of an arrangement in which there is provided between the end 7 and the top 8 of the jib 9 a loop 10, 11 composed of a suitable rope, preferably in conjunction with a light float 12 which enables this assembly to be placed in position, the loop being intended to be picked up by means of a line 13 thrown from the ship.

Once this connection has been made, traction is applied to the part 10 of the rope loop from the ship, so as to extract the cable 2, as indicated in FIG. 2, which shows an intermediate phase in the operation.

The connection to the float 12 is assumed to be detachable, so that the rope 10, 11 can be easily released.

When the extraction has been completed, the counterweight 3 bears against a suitable stop, which is preferably provided with appropriate damping means.

All that is then required is to make the connection between the free end of the hose 6 and the pipes on the ship.

In the final position reached, the mooring cable 2 is tensioned, so that the traction applied by the ship is taken by the platform P, which can assume a predetermined inclination in relation to the vertical, as indicated in FIG. 3.

In this position the platform P is suitably oriented, which is always possible because it is free to turn about the axis of the column C.

Nevertheless, in a particular arrangement steps are taken to ensure that in this final position the jib 9 has in plan a predetermined inclination A (FIG. 5) in relation to the direction of traction of the cable 2, this arrangement making it possible to avoid more easily any interaction between the hose 6 and the various cables concerned.

Figure 4:
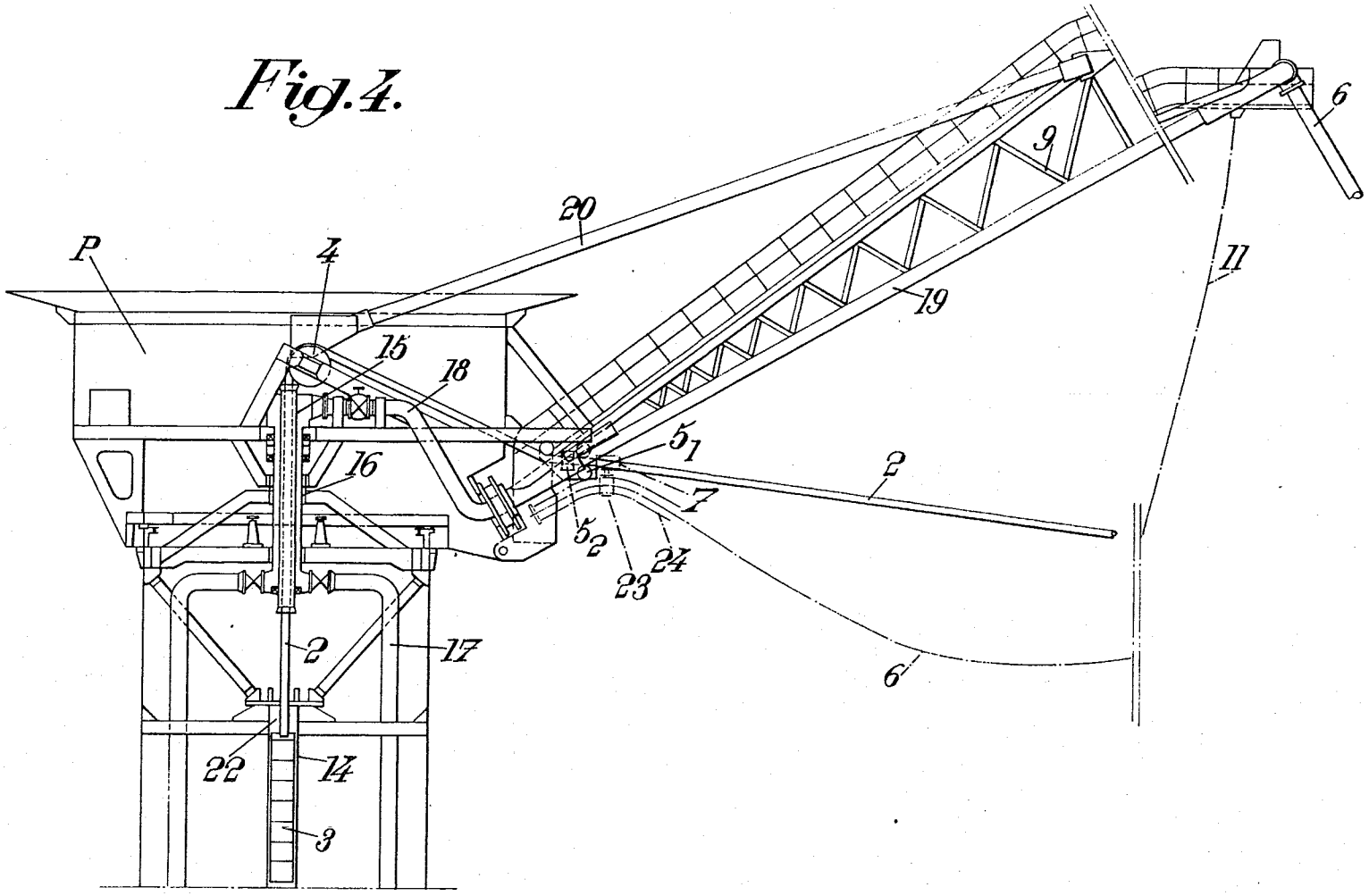
FIGS. 4 and 5 show to an enlarged scale, in partial elevation and in plan view respectively, a platform arranged forming a part of the apparatus.
Figure 5:
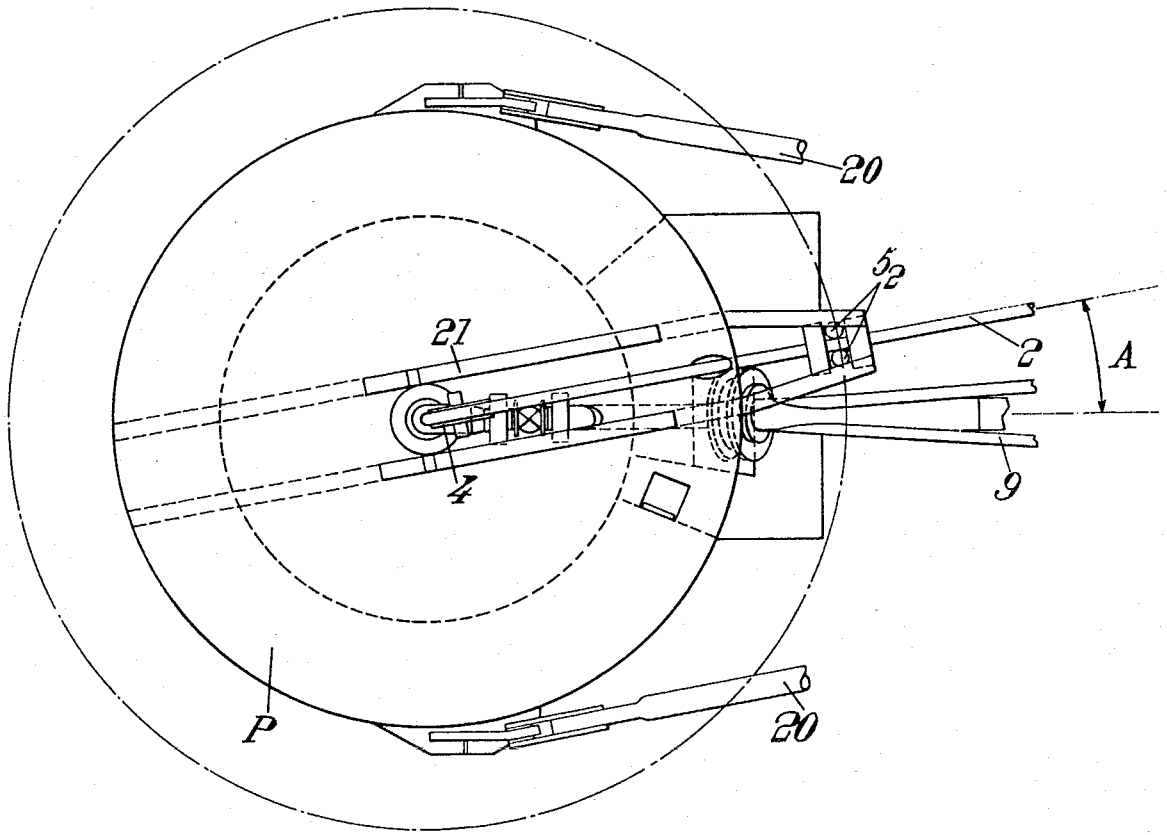

In FIGS. 4 and 5 are shown some details of the construction of the platform and of the elements associated with it.

In FIG. 4 it can be seen that the counterweight 3 is guided in a suitable tube 14. At its upper part the cable 2 passes through a guide 15, which in the embodiment illustrated is surrounded by a junction tube 16 through which fluid passes in order to travel through the column by way of pipes 17 to an oil well or to storage tanks. On the opposite side the tube 16 leads into pipes 18, 19 leading towards the top part of the jib 9, for connection to the flexible hose 6.

The jib 9 is held in place by struts 20.

After passing over the pulley 4 the cable 2 passes to the outside, passing through two horizontal rollers $5_1$ (FIG. 4) and through two vertical rollers $5_2$ (FIG. 5). This arrangement of rollers is carried by supports 21.

It can be seen that the supports 21 form an angle A with the direction of the jib 9.

In FIG. 4 the mooring cable 2 is shown in its extracted position, in which the counterweight 3 bears against a shock absorber device 22.

The end 7 in FIG. 4 is shown in broken lines, together with a device 23 which is fastened to the said end 7 and which in the non-mooring position makes it possible to hold the end 24 of the hose 6.

The device 23 or any other similar device will also serve to support the rope 10.

Apparatus according to the invention has advantages over previously existing systems, particularly:

the advantage of being particularly simple and avoiding the winches which are used in the usual mechanisms, and the advantage of achieving likewise very easy operation.

I claim:

1. Apparatus for mooring a ship comprising an elongate column, means for buoying said column in an upright manner in water, means for pivotally connecting the lower end of said column to a base anchored to a sea bed, a mooring cable having a first end for attaching to a ship to be moored and a second end attached to a counterweight moveable lengthwise of said column to permit extraction and retraction of said mooring cable out of and into said column, means for guiding the motion of said counterweight and cable lengthwise of said column and stop means for stopping the upward motion of said counterweight, said cable being arranged to be extracted from said column for the purpose of mooring a ship by traction applied by the ship to raise the counterweight against said stop means.

2. Apparatus according to claim 1 further including a boom mounted adjacent the upper end of said column, a flexible hose carried by said boom, means for placing a free end of said flexible hose in fluid communication with a fluid outlet on a ship, and means connecting said free end of said flexible hose to said mooring cable whereby the flexible hose is moveable therewith.

3. Apparatus according to claim 2 further including a rope attached at one end to the outer end of said boom and at the other end to said cable, a float secured to said rope intermediate its ends and positioned to float on the surface of the water in which the column is located, said rope forming a loop to facilitate picking up of said mooring cable for mooring a ship.

4. Apparatus according to claim 2 including means positioning said boom outwardly of said column, and means for guiding said cable outwardly of said column to a ship being moored at a fixed, predetermined angle, in plan view, with respect to said boom to prevent entangling of said hose and mooring cable.

5. Apparatus according to claim 4 further including shock absorbing means adjacent said stop means for absorbing shock of contact between a rising counterweight and said stop means.

6. Apparatus according to claim 2 including shock absorbing means adjacent said stop means for absorbing shock of contact between a rising counterweight and said stop means.

7. Apparatus according to claim 2 including shock absorbing means adjacent said stop means for absorbing shock of contact between a rising counterweight and said stop means.

8. Apparatus according to claim 1 further including shock absorbing means adjacent said stop means for absorbing shock of contact between a rising counterweight and said stop means.

* * * * *